US006471319B1

(12) United States Patent
Adkins et al.

(10) Patent No.: US 6,471,319 B1
(45) Date of Patent: Oct. 29, 2002

(54) METHOD FOR SYNCHRONIZING PRINT START POSITIONS FOR AN INKJET PRINTER CARRIAGE

(75) Inventors: Christopher Alan Adkins; Michael Anthony Marra, III; Randall David Mayo, all of Lexington, KY (US)

(73) Assignee: Lexmark International, Inc., Lexignton, KY (US)

( * ) Notice: Subject to any disclaimer, the term of this patent is extended or adjusted under 35 U.S.C. 154(b) by 0 days.

(21) Appl. No.: 09/901,881

(22) Filed: Jul. 9, 2001

(51) Int. Cl.[7] ..... B41J 29/38; B41J 23/00; B41J 21/16

(52) U.S. Cl. ..... 347/11; 347/37; 400/279

(58) Field of Search ..... 347/14, 37, 103; 400/279, 283, 705

(56) References Cited

U.S. PATENT DOCUMENTS

| | | | | | |
|---|---|---|---|---|---|
| 4,652,159 | A | | 3/1987 | Nagai | 400/322 |
| 4,877,343 | A | | 10/1989 | Hori | 400/121 |
| 5,438,352 | A | | 8/1995 | Agano | 347/183 |
| 5,620,266 | A | | 4/1997 | Kim | 400/279 |
| 5,803,628 | A | * | 9/1998 | Donahue | 400/279 |
| 5,873,663 | A | | 2/1999 | Yokoi et al. | 400/279 |
| 5,926,192 | A | * | 7/1999 | Yamane | 347/10 |
| 6,000,869 | A | | 12/1999 | Lee | 400/279 |
| 6,354,691 | B1 | * | 3/2002 | Uchikata | 347/37 |

* cited by examiner

*Primary Examiner*—John Barlow
*Assistant Examiner*—Alfred E. Dudding
(74) *Attorney, Agent, or Firm*—David A. Mancino; Jacqueline M. Daspit

(57) ABSTRACT

A method for synchronizing the print start position for a printer carriage on an inkjet printer that includes the steps of: (a) providing an encoder signal indicative of a position of an inkjet printer carriage relative to a substrate being printed upon or a printer platen, where the encoder signal is an alternating voltage signal with an encoder signal frequency; (b) filtering and dividing the encoder signal to provide a fire pulse signal, where the fire pulse signal is an alternating voltage signal with a fire pulse signal frequency that is a multiple of the encoder signal frequency; (c) detecting a rising edge of the encoder signal preceeding a predetermined print start position of the printer carriage; (d) upon detection of the rising edge of the encoder signal in step (c), detecting a next falling edge of the fire pulse signal; (e) upon detection of the next falling edge of the fire pulse signal in step (d), detecting a count of the next rising edges of the fire pulse signal; and (f) assigning a synchronized print start position at an end of the count.

20 Claims, 5 Drawing Sheets

METHOD FOR SYNCHRONIZING PRINT START POSITIONS FOR AN INKJET PRINTER CARRIAGE

TECHNICAL FIELD

The present invention relates generally to inkjet printing systems utilizing reciprocating inkjet printhead carriages and encoders for detecting the lateral position of the inkjet printer carriage and, more particularly, to a method for synchronizing print start position for an inkjet printhead carriage utilizing a low-pass filter on the encoder signal.

BACKGROUND OF THE INVENTION

Thermal inkjet printer mechanisms that utilize printhead having heater resistors for ejecting small ink droplets from the printhead are well-known. The ejection of a multitude of the small ink droplets at controlled locations on a printing substrate produces a desired printed image. In one such printer mechanism, the printhead is typically housed within a carriage that reciprocates back and forth laterally across the substrate, where the printhead includes a plurality of nozzles for ejecting the droplets onto controlled locations of the substrate. An optical encoder (or other type of sensor) is also housed within the carriage and the encoder traverses back and forth along an encoder strip to provide information to the printer controller relating to the lateral position of the carriage with respect to the substrate.

Many inkjet printers print with a maximum resolution that is significantly greater than the resolution of the optical encoder. For example, it is well known to have an inkjet printer with a maximum resolution of 1200×1200 dpi, where the feedback for the horizontal dimension in most cases is an optical encoder with a resolution of 150 lines per inch (1 pi). Therefore, in order to achieve a resolution of 1200 dpi, the encoder signal is divided into as many as eight parts or slices. These slices are generated so that they can provide even distribution of the allotted time period (i.e., the time between encoder pulses, or time to travel 1/150th of an inch), based upon the last measured time period. The slices are used to generate pseudo-fire pulses in logic hardware, which are in turn used to generate fire pulses that activate the printhead mechanisms or nozzles. When the encoder signal is changing quickly, or is corrupted with high frequency noise, print quality may be adversely affected.

SUMMARY OF THE INVENTION

In the present invention, a filter, such as a digital phase-locked loop (DPLL), is used to create the pseudo-fire pulses directly from the encoder signals. The DPLL will generate a digital signal whose frequency is a multiple of the encoder signal frequency and is in phase with the encoder signal. This signal produced by the DPLL will be used as the pseudo-fire pulse signal from which fire pulses to the printhead are generated. The DPLL provides a low-pass filtering of the encoder signal, which results in better dot placement capability.

A frequency multiplying property of the DPLL can be easily varied to allow the frequency of the output signal to be a selectable multiple of the output signal. This characteristic provides for a varying addressable print resolution, which can be used for either future higher resolution products, or better alignment features on a 1200 dpi inkjet printer. In the above example, by changing the divider component of the DPLL to 16, the addressable printer resolution will become 2400 dpi.

Because of the filtering properties of the DPLL, the rising edges of the unfiltered encoder signal may not precisely coincide with the corresponding rising edge of the filtered pseudo-fire pulse signal. The signals may exhibit some misalignment depending upon the filter characteristics. Accordingly, the present invention provides methods for synchronizing the print start positions of the inkjet printhead utilizing such a DPLL.

Accordingly, it is a first aspect of the present invention to provide a method for synchronizing the print start position for a printer carriage on an inkjet printer that includes the steps of: (a) providing an encoder signal indicative of a position on an inkjet printer carriage relative to either the substrate being printed upon or a printer platen; (b) filtering the encoder signal to provide a filtered encoder signal; (c) detecting an activation in the encoder signal preceding a predetermined print start position of the printer carriage; (d) upon detection of the activation of the encoder signal in step (c), detecting a next deactivation of the filtered encoder signal; (e) upon detecting the next deactivation of the filter encoder signal in step (d), detecting a count of the next activations of the filtered encoder signal; and (f) assigning a synchronized print start position at an end of a count. In a more detailed embodiment, the count is one or more of the next activations of the filtered encoder signal. In yet a further detailed embodiment, the method further comprises the step of calculating the count based, at least in part, upon a difference between a carriage position corresponding to the activation of the encoder signal detected in step (c) and the predetermined print start position.

In an alternate detailed embodiment of this first aspect of the present invention, the encoder signal and the filtered encoder signal are alternating voltage level signals, alternating at an encoder signal frequency and a filtered encoder signal frequency, respectively; the activation of the encoder signal is the rising edge of the encoder signal; the activation of the filtered encoder signal is the rising edge of the filtered encoder signal; and the deactivation of the filtered encoder signal is the falling edge of the filtered encoder signal. In a further detailed embodiment, the step of filtering includes a step of multiplying the encoder signal frequency to produce a filtered encoder signal frequency that is a multiple of the encoder signal frequency. In yet a further detailed embodiment, the multiple of the encoder signal frequency for the filtered encoder signal frequency is selectable. In yet a further detailed embodiment, the filter is a digital phase-locked loop (DPLL).

It is a second aspect of the present invention to provide a method for synchronizing the print start position for a printer carriage on an inkjet printer that includes the steps of: (a) providing an encoder signal indicative of a position of an inkjet printer carriage relative to a substrate being printed upon or a printer platen, where the encoder signal is an alternating voltage signal with an encoder signal frequency; (b) filtering and dividing the encoder signal to provide a fire pulse signal, where the fire pulse signal is an alternating voltage signal with a fire pulse signal frequency that is a multiple of the encoder signal frequency; (c) detecting a rising edge of the encoder signal preceding a predetermined print start position of the printer carriage; (d) upon detection of the rising edge of the encoder signal in step (c), detecting a next falling edge of the fire pulse signal; (e) upon detection of the next falling edge of the fire pulse signal in step (d), detecting a count of the next rising edges of the fire pulse signal; and (f) assigning a synchronized print start position at an end of the count. In a further detailed embodiment, the method further includes a step of calculating the count based, at least in part, upon a difference between a carriage position corresponding to the rising edge of the encoder signal detected in steps (c) and the predetermined print start position.

A third aspect of the present invention is directed to a method for synchronizing the print start position for a printer carriage on an inkjet printer that includes the steps of: (a) providing an encoder signal indicative of a position on an inkjet printer carriage relative to either a substrate being printed upon or a printer platen; (b) filtering the encoder signal by a first filter to provide an intermediate encoder signal; (c) filtering the intermediate encoder signal by a second filter to provide a filtered encoder signal; (d) detecting an activation in the encoder signal preceding a predetermined print start position of the printer carriage; (e) upon detection of the activation of the encoder signal in step (d), detecting a next deactivation of the intermediate encoder signal; (f) upon detecting the next deactivation of the intermediate encoder signal in step (e) detecting a first count of the next activations of the intermediate encoder signal; (g) at an end of the first count, detecting a next deactivation of the filter encoder signal; (h) upon detecting the next deactivation of the filtered encoder signal in step (g) detecting a second count of the next activations of the filtered encoder signal; and (i) assignment a synchronized print start position at an end of the second count. In a more detailed embodiment, the method further includes the steps of: calculating the first count based, at least in part, upon a difference between a carriage position corresponding to the activation of the encoder signal in step (d) in the predetermined print start position, and calculating the second count base, at least in part, upon the difference between the carriage position corresponding to the end of the first count and the predetermined start position.

In an alternate detailed embodiment of the third aspect of the present invention described above, the encoder signal, the intermediate encoder signal and the filtered encoder signal are alternating voltage level signals, alternating at an encoder signal frequency, an intermediate encoder frequency and a filtered encoder signal frequency, respectively; the activation of the encoder signal is the rising edge of the encoder signal; the activation of the intermediate encoder signal is the rising edge of the intermediate encoder signal and the deactivation of the intermediate encoder signal is the falling edge of the intermediate encoder signal; and the activation of the filtered encoder signal is the rising edge of the filtered encoder signal and the deactivation of the filtered encoder signal is the falling edge of the filtered encoder signal. In yet a further detailed embodiment, the step (b) of filtering the encoder signal includes a step of multiplying the encoder signal frequency to produce and intermediate encoder signal frequency that is a multiple of the encoder signal frequency, and the step (c) of filtering the intermediate encoder signal includes a step of multiplying the intermediate encoder signal frequency to produced a filtered encoder signal frequency that is a multiple of the intermediate encoder signal frequency.

A fourth aspect of the present invention is directed to a method for synchronizing the print start position for a printer carriage on an inkjet printer that includes the steps of: (a) providing an encoder signal indicative of a position of an inkjet printer carriage relative to either a substrate being printed upon or a printer platen, where the encoder signal is an alternating voltage signal with an encoder signal frequency; (b) filtering and dividing the encoder signal to provide an intermediate encoder signal, where the intermediate encoder signal is an alternating voltage signal with an intermediate encoder signal frequency that is a multiple of the encoder signal frequency; (c) filtering and dividing the intermediate signal to provide a fire pulse signal, where the fire pulse signal is an alternating voltage signal with a fire pulse signal frequency that is a multiple of the intermediate signal frequency; (d) detecting a rising edge of the encoder signal preceding a predetermined print start position of the printer carriage; (e) upon detecting of the rising edge of the encoder signal in step (d), detecting a next falling edge of the intermediate encoder signal; (f) upon detection of the next falling edge of the intermediate encoder signal in step (e), detecting a first count of the next rising edges of the intermediate encoder signal; (g) at an end of the first count, detecting a next falling edge of the fire pulse signal; (h) upon detection of the next falling edge of the fire pulse signal in step (g), detecting a second count of the next rising edges of the fire pulse signal, and (i) assigning a synchronized print start position at an end of the second count. In a further detailed embodiment, the method further includes the steps of calculating the first count base, at least in part, upon a difference between a carriage position corresponding to the rising edge of the encoder signal in step (d) and the predetermined start position, and calculating the second count based, at least in part, upon a difference between the carriage position corresponding to the end of the first count and the predetermined print start position.

DETAILED DESCRIPTION

Figure 1:
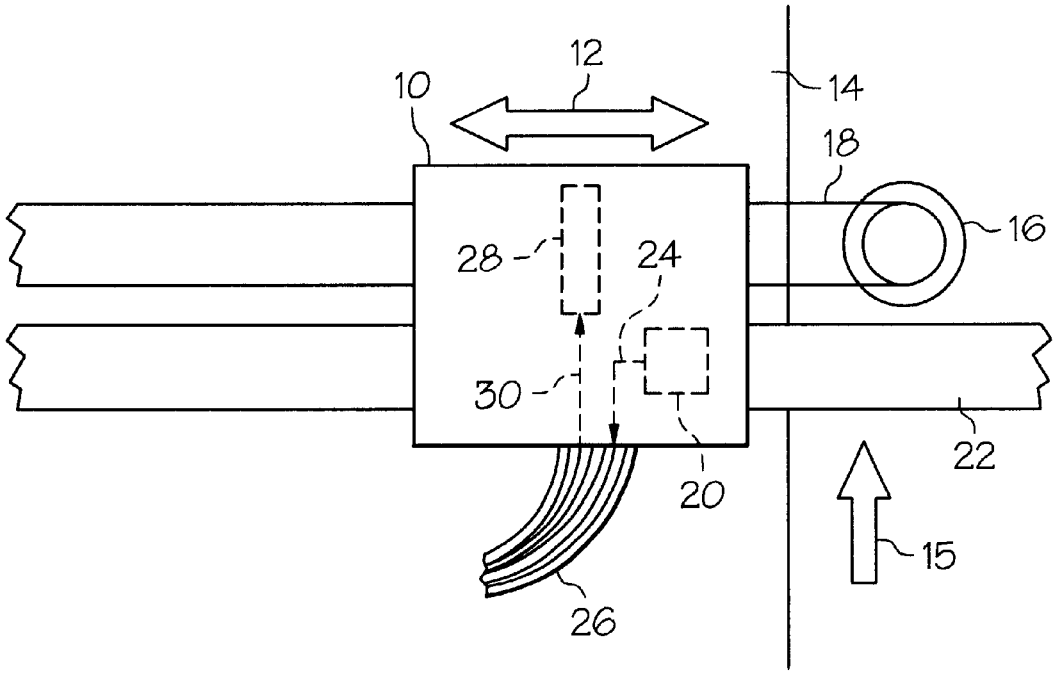
FIG. 1 is a schematic block diagram of an inkjet printer carriage assembly.

As shown in FIG. 1, a conventional inkjet printer carriage assembly includes a printer carriage 10 mounted for reciprocation in the direction provided by arrows 12 laterally back and forth along a substrate 14 to be printed upon, moving in the direction provided by arrow 15. The lateral position of the carriage 10 is controlled by a DC motor 16 with associated belt drive 18. An optical encoder or sensor 20 is housed within the carriage 10 and operates in conjunction with the lineal encoder strip 22 to provide encoder signals 24 indicative of the position of the carriage 10 relative to the substrate 14 or relative to the printer platen (not shown) carrying the substrate 14. These signals are carried by a ribbon 26 (data bus) to a printer controller 34 (shown schematically in FIG. 2). Also housed within the carriage is a printhead 28 of conventional design controlled by fire pulse signals 30 provided by the printer controller via ribbon 26.

Figure 2:
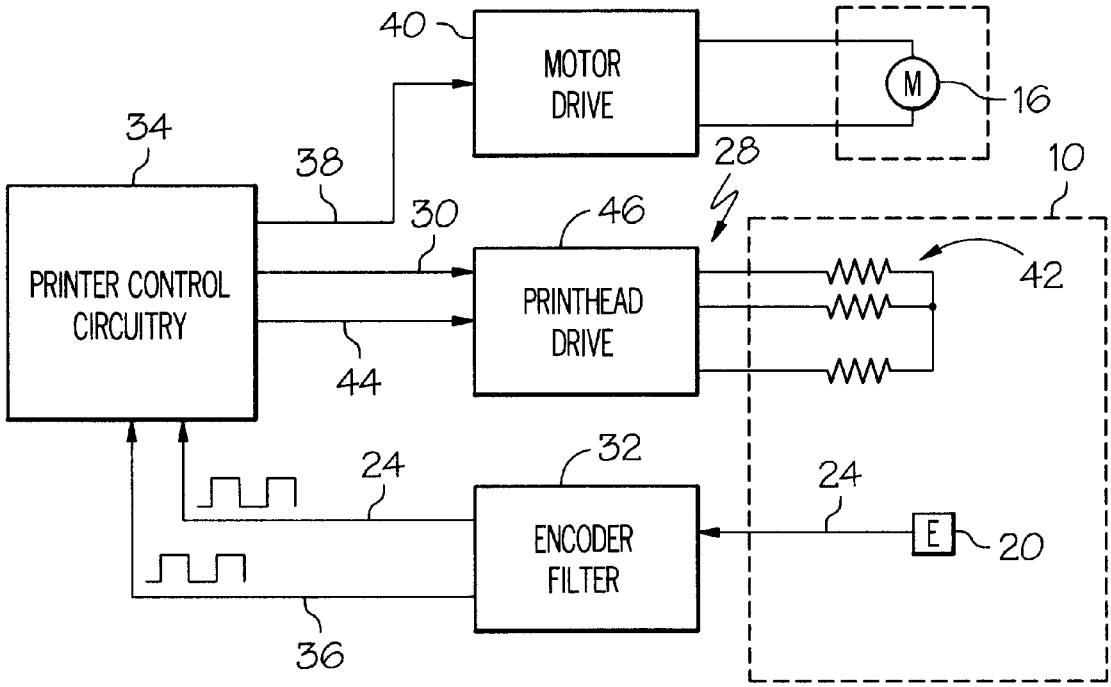
FIG. 2 is a schematic block diagram of an inkjet printer carriage control circuitry.

As shown in FIG. 2, the output of the encoder 24 is received by an encoder filter 32, which will be described in greater detail below. The encoder filter 32 relays the unfiltered encoder signal 24 to the printer control circuitry 34 and also transmits the filtered encoder signal, referred to herein as pseudo fire-pulses 36, to the printer control circuitry 34. Based upon the known position of the carriage 10 and the image to be printed, the printer control circuitry 34 operates the motor 16, via motor drive signals 38 to a motor drive circuit 40, and activates the inkjet printer elements 42 by sending control data 44 and the fire pulse signals 30 to the printhead drive circuitry 46.

Figure 3:
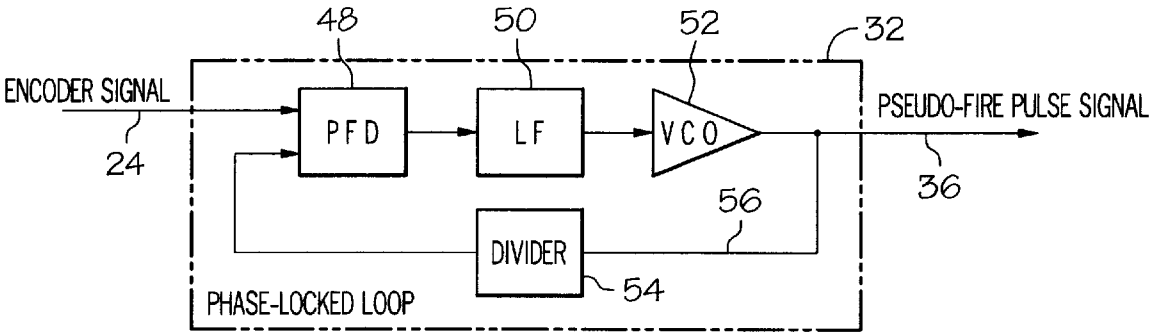
FIG. 3 is a schematic block diagram of the digital phase-locked looped circuitry for filtering the encoder signal.

As shown in FIG. 3, the encoder filter circuitry 32, in the exemplary embodiment, is a digital phase-locked loop (DPLL) used to create pseudo-fire pulse signals 36 directly from the encoder signal 24. As discussed above, the pseudo-fire pulse signals are used to generate the fire pulses 30 that are sent to the printhead drive circuitry 46. The DPLL provides low-pass filtering of the encoder signal 24, which allows for better dot placement on the substrate 14 by the printhead 28.

The DPLL is made up of three main components, a phase-frequency detector (PFD) 48, a loop filter (LF) 50, and a voltage controller oscillator (VCO) 52. In the DPLL of the exemplary embodiment, the PFD is made of digital devices and the LF and VCO are analog devices. As will be apparent to those of ordinary skill in the art, most ASIC vendors have LF and VCO modules available. The PFD can be custom designed to best meet the needs of the system. The divider component 54 set in the feedback loop 56 sets the frequency of the DPLL output (pseudo fire pulse signal) as a multiple of the input encoder signal. For example, if the encoder signal is 3 kHZ (150 lines per inch at 20 inches per second ("ips")) and the divider is 8, then the pseudo-fire pulse signal 36 will have a frequency of 24 kHZ (1200 dots per inch at 20 ips). In the exemplary embodiment, the frequency multiplying property of the DPLL can be easily changed allowing the frequency of the output signal to be a selectable, multiple of the input signal. This may be accomplished by providing a programmable divider with selectable values, which can be changed on the fly using commands transmitted by the printer control circuitry 34, for example. This variable divider characteristic provides for a varying addressable print resolution, which can be used for either future higher resolution products, or better alignment features on a 1200 dpi inkjet. For example, by changing the divider to 16, the addressable printing resolution will become 2400 dpi. It should also be apparent to those of ordinary skill in the art that the dividing value need not be a multiple of two as with the exemplary embodiments discussed herein.

Figure 4:
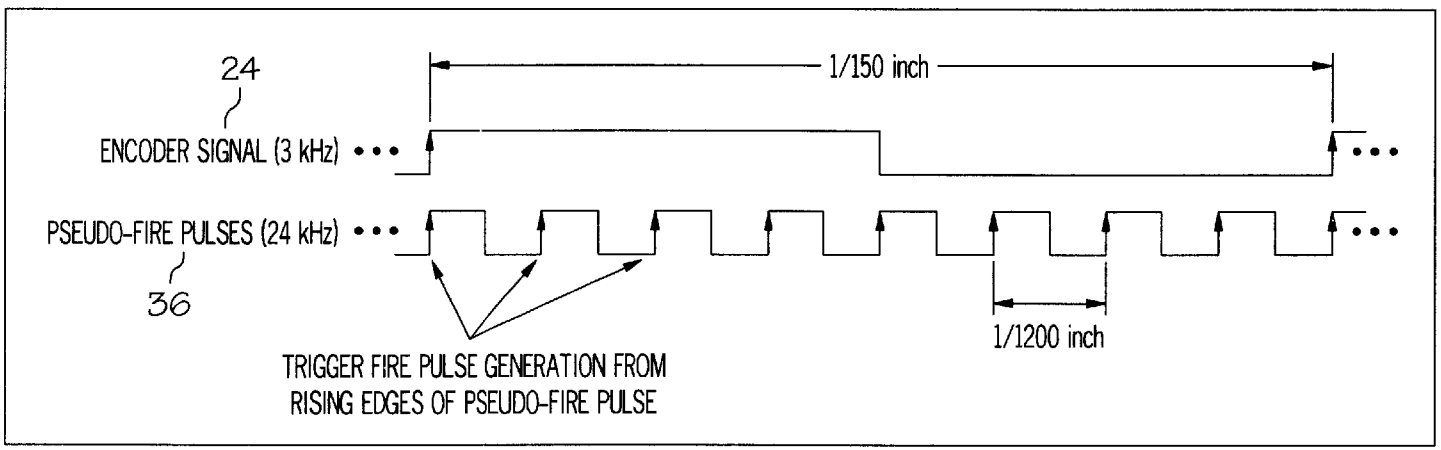
FIG. 4 is a timing diagram illustrating operation of the DPLL fire pulse generation.

FIG. 4 provides a timing diagram illustrating the operation of one possible implementation of the DPLL fire pulse generation scheme, based upon a 1200 dpi, 20 ips example given above. The DPLL 32 generates a 24 kHZ filtered pseudo-fire pulse signal 36 with the resolution of 1200 dpi from the 3 kHZ encoder signal 24, which has a resolution of 150 1pi. The rising edges of the pseudo-fire pulses are used to trigger the generation of the actual fire pulses 30 to the printhead. In this way, the characteristics of the fire pulses (pre-fire, delay, etc.) can easily be varied as desired.

Figure 5:
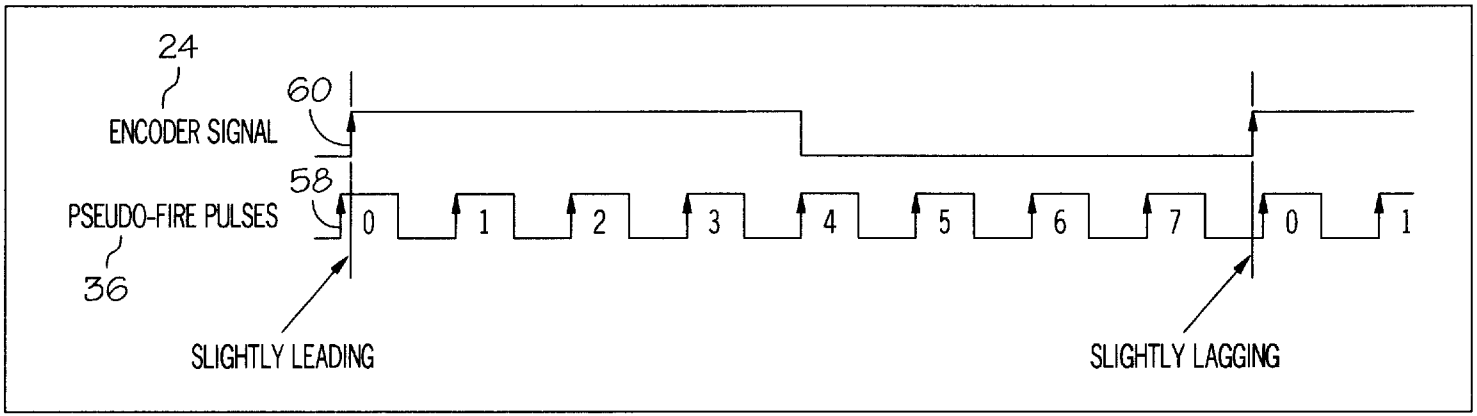
FIG. 5 is a timing diagram illustrating misalignment between the unfiltered encoder signal and the filtered pseudo-fire pulse signal.

As shown in FIG. 5, because of the filtering properties of the DPLL 32, the rising edges of the encoder signal 24 may not precisely coincide with the corresponding rising edge of the pseudo-fire pulse signal 36. The signals may exhibit some misalignment depending upon the filter characteristics. For instance, as illustrated in FIG. 5, the rising edge of the pseudo-fire pulse zero 58 (corresponding to the first pseudo-fire pulse generated in the particular encoder period) may slightly lead or trail the rising edge of the encoder signal 60. Because of this scenario, the present invention provides the method for synchronizing the print start position for every line to be printed. This method will be illustrated with the timing diagram shown in FIG. 6.

Figure 6:
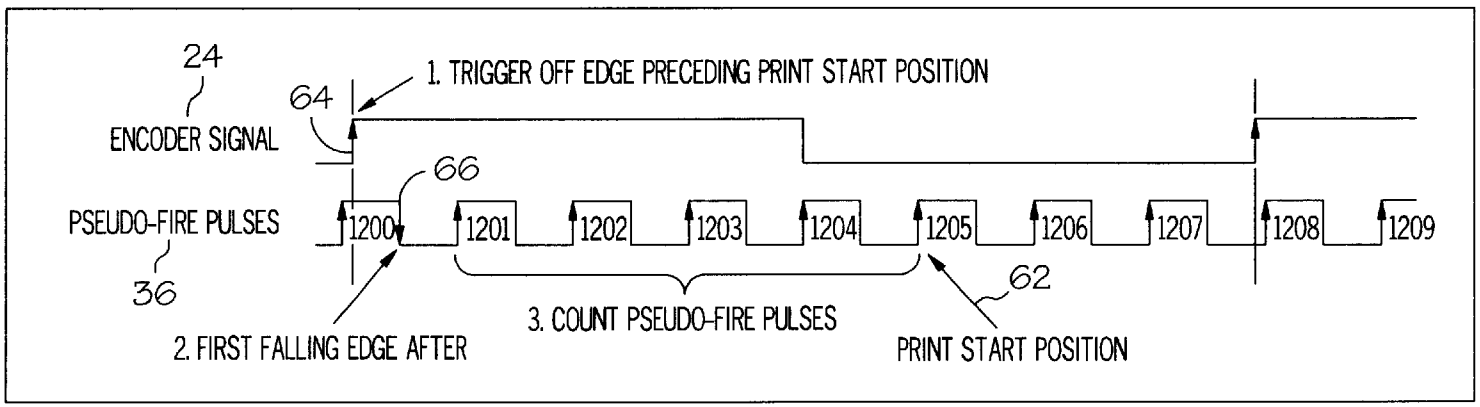
FIG. 6 is a timing diagram illustrating the synchronization of the print start position according to the method of the present invention.

As with the previously examples, the timing diagram of FIG. 6 illustrates a pseudo-fire pulse signal 36 generated by a DPLL circuit 32 with a divider set at 8. Therefore, with the encoder signal of 3 kHZ (corresponding to 150 1pi at 20 ips), the pseudo-fire pulse signal has a frequency of 24 kHZ (corresponding to 1200 dpi at 20 ips). Assuming that the desired print start position 62 is set at pixel position 1205, the method proceeds as follows. First, the rising edge 64 of the encoder signal 24 preceeding the print start position 62 is detected. Next, upon the detection of this rising edge 64 of the encoder signal, the next falling edge 66 of the fire pulse signal is detected. Knowing that this next falling edge 66 will correspond to the pseudo-fire pulse for pixel number 1200, a count is calculated based upon the difference of the desired print start position at pixel 1205 and the present pixel number 1200. In this example, the count equals five. The next step in the method is to detect the count of the next rising edges of the pseudo-fire pulse signal 36 until the number of rising edges equals the count calculated in the previous step (i.e., count five rising edges of the pseudo-fire pulse signal). At this point, the desired print start position has been reached.

By utilizing this method for every scan line, the print start position for each scan line will be synchronized. It is noted that with this method, the filtered pseudo-fire pulse signal 36 may lead or lag the unfiltered encoder signal 24 by as much as one half of a pseudo-fire pulse signal period.

Figure 7:
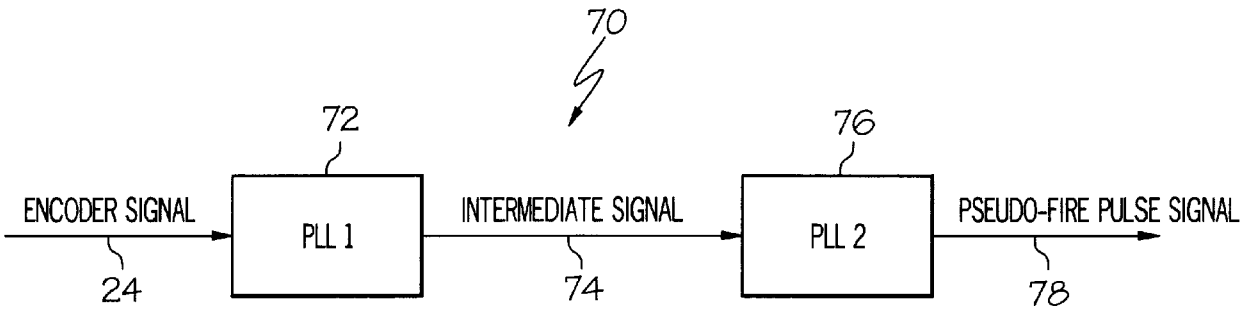
FIG. 7 is a schematic block diagram of a multi-staged DPLL configuration for use as the encoder filter in the present invention.
Figure 8:
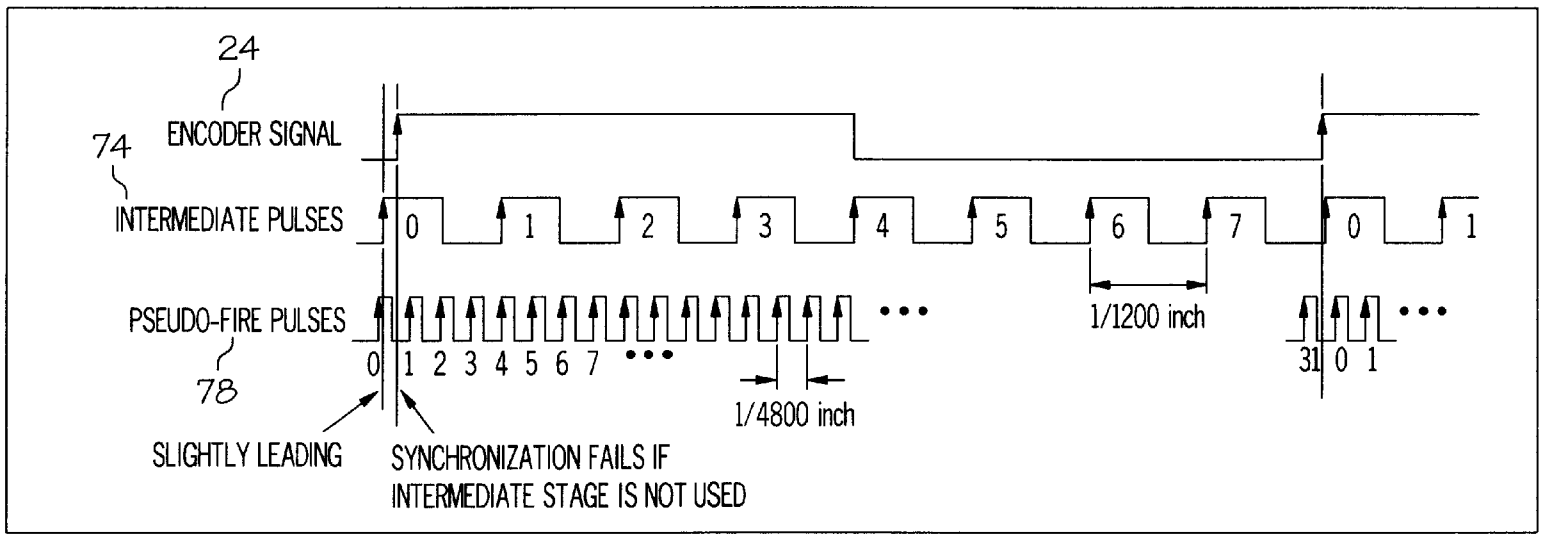
FIG. 8 is a timing diagram illustrating the unfiltered encoder signal, the intermediate signal generated by the first stage of the filter, and the pseudo-fire pulse signal generated by the second stage of the filter of FIG. 7.

FIG. 7 provides an alternate exemplary embodiment of an encoder filter70 for use with the present invention. The alternate encoder filter 70 is a multi-stage DPLL circuit having a first DPLL stage 72 and a second DPLL stage 76. The first DPLL stage receives the encoder signal 24 and provides an intermediate filtered signal 74 to the second DPLL stage 76 which filters the intermediate signal 74 to provide the pseudo-fire pulse signal 78. Referring to FIG. 8, in an example of this two-stage filter/fire pulse generation scheme, the first stage may provide a 1200 pulse per inch signal 74 from the 150 pulse per inch encoder signal 24; and the second stage may then provide a 4800 pulse per inch signal 78 from the 1200 pulse per inch intermediate signal 74. Each stage provides some level of filtering, thus enabling a better overall filter response. The multiple stages may also be used to provide an even more robust synchronization of the print start position as illustrated in the timing diagram of FIG. 9.

Figure 9:
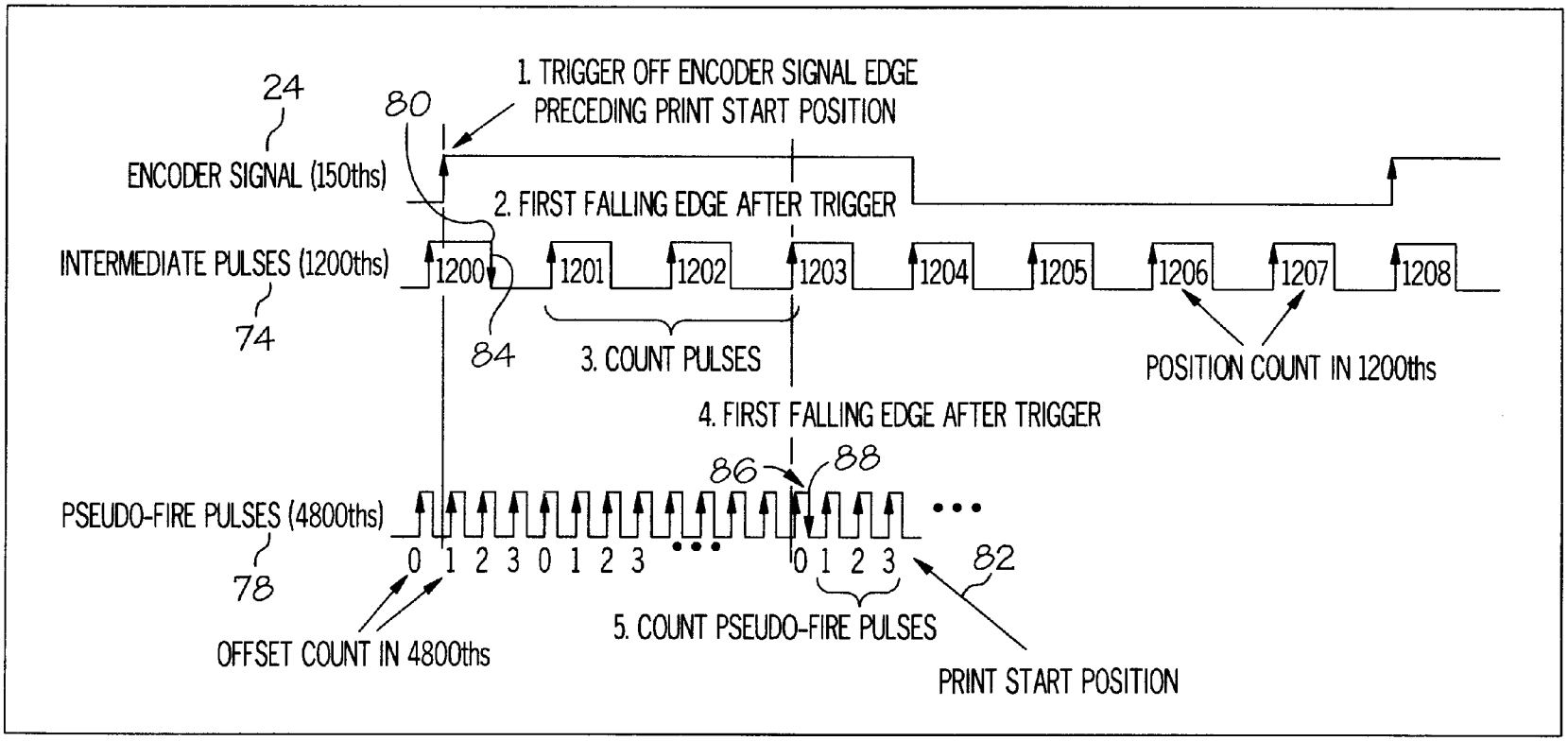
FIG. 9 is a timing diagram illustrating the method for synchronizing the print start position for the multi-stage filter of FIG. 7 according to an alternate exemplary embodiment of the present invention.

The method for synchronizing the print start position for a plurality of scan lines with the multi-stage DPLL circuit 70 is described with the example illustrated in FIG. 9. The first step is to detect the rising edge 80 of the original encoder signal that proceeds the desired print start position 82. The next step is to detect the next falling edge 84 of the intermediate pulse signal 74. Once the next falling edge 84 the intermediate signal 74 is detected, the next step is to count the next rising edges of the intermediate pulses 74 until the rising edge 86 that proceeds the desired print start position 82 has been reached. In this example, this count is based upon a difference between the pulse number of the intermediate pulses 74 with the rising edge 86 immediately preceding the print start position 82 (pulse number 1203) and the pulse number of the pulse from which the next falling edge 84 was detected above (pulse number 1200). The next step is to wait for the next falling edge 88 of the pseudo-fire pulse signal 78. Finally, the last step is to count the next rising edges of the pseudo-fire pulses 78 until the print start position has been reached. In this example, this count is based upon a difference between the number of the pseudo-fire pulses 78 at the desired print start position (pseudo-fire pulse number 3) and the pseudo-fire pulse number of the pseudo-fire pulse from which the next falling edge 88 was detected above (pseudo-fire pulse number 0).

As will be appreciated by those of ordinary skill in the art while the filtering stages of the present invention utilize digital phase lock loops, other filtering techniques that provide zero phase are also applicable. Some of these techniques are outlined in U.S. patent application Ser. No. 09/736,075, filed Dec. 13, 2000, Docket No. 2000-0110, entitled "Printer System With Encoder Filtering Arrangement and Method for High Frequency Error Reduction." As will be appreciated to those of ordinary skill in the art, it is within the scope of the invention to use any of these filters with the method of the present invention.

Following from the above descriptions and summaries, it should be apparent to those of ordinary skill in the art that, while the apparatuses and processes herein described constitute exemplary embodiments of the present invention, it is to be understood that the invention is not limited to these precise apparatuses and processes, and that changes may be made therein without departing from the scope of the invention as defined by the claims. Additionally, it is to be understood that the invention is defined by the claims and it is not intended that any limitations or elements describing the exemplary embodiments herein are to be incorporated into the meanings of the claims unless such limitations or elements are specifically listed in the claims. Finally, it is to be understood that it is not necessary to meet any or all of the stated advantages or objects of the present invention disclosed herein in order to fall within the scope of any claims, since the invention is defined by the claims and such inherent and/or unforeseen advantages of the present invention may exist even though they may not have been explicitly discussed herein.

What is claimed is:

1. A method for synchronizing the print start position for a printer carriage on an inkjet printer comprising the steps of:

(a) providing an encoder signal indicative of a position of an inkjet printer carriage relative to one of a substrate being printed upon and a printer platen;

(b) filtering the encoder signal to provide a filtered encoder signal;

(c) detecting an activation in the encoder signal preceding a predetermined print start position of the printer carriage relative to the one of the substrate being printed upon and the printer platen;

(d) upon detection of the activation in the of the encoder signal in step (c), detecting a next deactivation of the filtered encoder signal;

(e) upon detecting the next deactivation of the filtered encoder signal in step (d), detecting a count of the next activations of the filtered encoder signal; and (f) assigning a synchronized print start position at an end of the count.

2. The method of claim 1, wherein the count is one or more of the next activations of the filtered encoder signal.

3. The method of claim 2, further comprising the step of calculating the count based, at least in part, upon a difference between a carriage position corresponding to the activation of the encoder signal detected in step (c) and the predetermined print start position.

4. The method of claim 1, wherein:

the encoder signal and the filtered encoder signal are alternating voltage level signals, alternating at an encoder signal frequency and a filtered encoder signal frequency, respectively;

the activation of the encoder signal is the rising edge of the encoder signal;

the activation of the filtered encoder signal is the rising edge of the filtered encoder signal; and the deactivation of the filtered encoder signal is the falling edge of the filtered encoder signal.

5. The method of claim 4, wherein the step of filtering includes a step of multiplying the encoder signal frequency to produce a filtered encoder signal. frequency that is a multiple of the encoder signal frequency.

6. The method of claim 5, wherein the multiple of the encoder signal frequency for the filtered encoder signal frequency is selectable.

7. The method of claim 5, wherein the filter is a digital phase-locked loop (DPLL).

8. The method of claim 1, wherein the filter is a digital phase-locked loop (DPLL).

9. The method of claim 1, wherein the filter is a low-pass filter.

10. The method of claim 1, wherein the filtered encoder signal is transmitted to the printer carriage as a fire pulse signal.

11. A method for synchronizing the print start position for a printer carnage on an inkjet printer comprising the steps of:

(a) providing an encoder signal indicative of a position of an inkjet printer carriage relative to one of a substrate being printed upon and a printer platen, the encoder signal being an alternating voltage signal with an encoder signal frequency;

(b) filtering and dividing the encoder signal to provide a fire pulse signal, the fire pulse signal being an alternating voltage signal with a fire pulse signal frequency that is a multiple of the encoder signal frequency;

(c) detecting a rising edge of the encoder signal preceding a predetermined print start position of the printer carriage relative to the one of the substrate being printed upon and the printer platen;

(d) upon detection of the rising edge of the of the encoder signal in step (c), detecting a next falling edge of the fire pulse signal;

(e) upon detection of the next falling edge of the fire pulse signal in step (d), detecting a count of the next rising edges of the fire pulse signal; and (f) assigning a synchronized print start position at an end of the count.

12. The method of claim 11, further comprising the step of calculating the count based, at least in part, upon a difference between a carriage position corresponding to the rising edge of the encoder signal detected in step (c) and the predetermined print start position.

13. A method for synchronizing the print start position for a printer carriage on an inkjet printer comprising the steps of:

(a) providing an encoder signal indicative of a position of an inkjet printer carriage relative to one of a substrate being printed upon and a printer platen;

(b) filtering the encoder signal by a first filter to provide an intermediate encoder signal;

(c) filtering the intermediate encoder signal by a second filter to provide a filtered encoder signal;

(d) detecting an activation in the encoder signal preceding a predetermined print start position of the printer carriage relative to the one of the substrate being printed upon and the printer platen;

(e) upon detection of the activation in the of the encoder signal in step (d), detecting a next deactivation of the intermediate encoder signal;

(f) upon detecting the next deactivation of the intermediate encoder signal in step (e), detecting a first count of the next activations of the intermediate encoder signal;

(g) at an end of the first count, detecting a next deactivation of the filtered encoder signal;

(h) upon detecting the next deactivation of the filtered encoder signal in step (g), detecting a second count of the next activations of the filtered encoder signal; and (i) assigning a synchronized print start position at an end of the second count.

14. The method of claim 13, further comprising the steps of:

calculating the first count based, at least in part, upon a difference between a carriage position corresponding to the activation of the encoder signal in step (d) and the predetermined print start position; and calculating the second count based, at least in part, upon a difference between a carriage position corresponding to the end of the first count and the predetermined print start position.

15. The method of claim 13, wherein:

the encoder signal, the intermediate encoder signal and the filtered encoder signal are alternating voltage level signals, alternating at an encoder signal frequency, and intermediate encoder signal frequency and a filtered encoder signal frequency, respectively;

the activation of the encoder signal is the rising edge of the encoder signal;

the activation of the intermediate encoder signal is the rising edge of the intermediate encoder signal and the deactivation of the intermediate encoder signal is the falling edge of the intermediate encoder signal; and the activation of the filtered encoder signal is the rising edge of the filtered encoder signal and the deactivation of the filtered encoder signal is the falling edge of the filtered encoder signal.

16. The method of claim 15, wherein:

the step (b) of filtering the encoder signal includes a step of multiplying the encoder signal frequency to produce an intermediate encoder signal frequency that is a multiple of the encoder signal frequency; and the step (c) of filtering the intermediate encoder signal includes a step of multiplying the intermediate encoder signal frequency to produce a filtered encoder signal frequency that is a multiple of the intermediate encoder signal frequency.

17. The method of claim 13 wherein the first and second filters are digital phase-locked loops (DPLLs).

18. The method of claim 13 wherein the first and second filters are lowpass filters.

19. A method for synchronizing the print start position for a printer carriage on an inkjet printer comprising the steps of:

(a) providing an encoder signal indicative of a position of an inkjet printer carriage relative to one of a substrate being printed upon and a printer platen, the encoder signal being an alternating voltage signal with an encoder signal frequency;

(b) filtering and dividing the encoder signal to provide an intermediate encoder signal, the intermediate encoder signal being an alternating voltage signal with an intermediate encoder signal frequency that is a multiple of the encoder signal frequency;

(c) filtering and dividing the intermediate signal to provide a fire pulse signal, the fire pulse signal being an alternating voltage signal with a fire pulse signal frequency that is a multiple of the intermediate signal frequency;

(d) detecting a rising edge of the encoder signal preceding a predetermined print start position of the printer carriage relative to the one of the substrate being printed upon and the printer platen;

(e) upon detection of the rising edge of the of the encoder signal in step (d), detecting a next falling edge of the intermediate encoder signal;

(f) upon detection of the next falling edge of the intermediate encoder signal in step (e), detecting a first count of the next rising edges of the intermediate encoder signal;

(g) at an end of the first count, detecting a next falling edge of the fire pulse signal;

(h) upon detection of the next falling edge of the fire pulse signal in step (g), detecting a second count of the next rising edges of the fire pulse signal; and (i) assigning a synchronized print start position at an end of the second count.

20. The method of claim 19, further comprising the steps of:

calculating the first count based, at least in part, upon a difference between a carriage position corresponding to the rising edge of the encoder signal in step (d) and the predetermined print start position; and calculating the second count based, at least in part, upon a difference between a carriage position corresponding to the end of the first count and the predetermined print start position.

* * * * *